US008197607B2

(12) United States Patent
Dedegil et al.

(10) Patent No.: US 8,197,607 B2
(45) Date of Patent: Jun. 12, 2012

(54) DISHWASHER COMPRISING A FILTER SYSTEM

(75) Inventors: M. Yavuz Dedegil, Karlsruhe (DE); Rüdiger Eiermann, Syrgenstein (DE); Helmut Jerg, Giengen (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 1665 days.

(21) Appl. No.: 10/582,924

(22) PCT Filed: Dec. 9, 2004

(86) PCT No.: PCT/EP2004/053372

§ 371 (c)(1),
(2), (4) Date: Apr. 30, 2007

(87) PCT Pub. No.: WO2005/058125

PCT Pub. Date: Jun. 30, 2005

(65) Prior Publication Data

US 2007/0277859 A1 Dec. 6, 2007

(30) Foreign Application Priority Data

Dec. 18, 2003 (DE) ..... 103 59 615

(51) Int. Cl.
*B08B 3/00* (2006.01)

(52) U.S. Cl. ..... 134/10; 134/25.2; 134/57 D; 134/58 D; 134/110; 210/703; 210/706; 210/221.1; 210/221.2

(58) Field of Classification Search ..... 134/110
See application file for complete search history.

(56) References Cited

U.S. PATENT DOCUMENTS

| | | | | |
|---|---|---|---|---|
| 5,234,112 | A * | 8/1993 | Valenzuela et al. | 209/169 |
| 5,910,248 | A | 6/1999 | Tlok | |
| 6,001,191 | A * | 12/1999 | Kamikawa et al. | 134/32 |
| 6,402,855 | B1 * | 6/2002 | Damron et al. | 134/10 |
| 6,413,366 | B1 * | 7/2002 | Kemper | 162/60 |
| 2002/0074026 | A1 * | 6/2002 | Kim et al. | 134/104.1 |

FOREIGN PATENT DOCUMENTS

| | | |
|---|---|---|
| EP | 0 536 620 | 4/1993 |
| EP | 1 340 448 | 9/2003 |
| WO | WO 99/43251 | 9/1999 |

OTHER PUBLICATIONS

International Search Report PCT/EP2004/053372.

* cited by examiner

*Primary Examiner* — Michael Kornakov
*Assistant Examiner* — Nicole Blan
(74) *Attorney, Agent, or Firm* — James E. Howard; Andre Pallapies

(57) ABSTRACT

A dishwasher is provided having a dishwashing container and a filter system for cleaning dishwashing liquid. The filter system includes a foam volume and the filter system and the dishwashing container are communicated with one another such that at least some of the dishwashing liquid can be discharged from the dishwashing container in association with a washing cycle of the dishwashing machine to the foam volume for passage of the discharged dishwashing liquid through the foam volume. Dishwashing residue contained in the dishwashing liquid is at least partially absorbed or retained by the foam volume such that the fine-grained dirt particles can be filtered out of the dishwashing fluid, a resoiling of the dishwashing fluid or the items to be cleaned can be minimized and the dishwashing result can be improved.

15 Claims, 1 Drawing Sheet

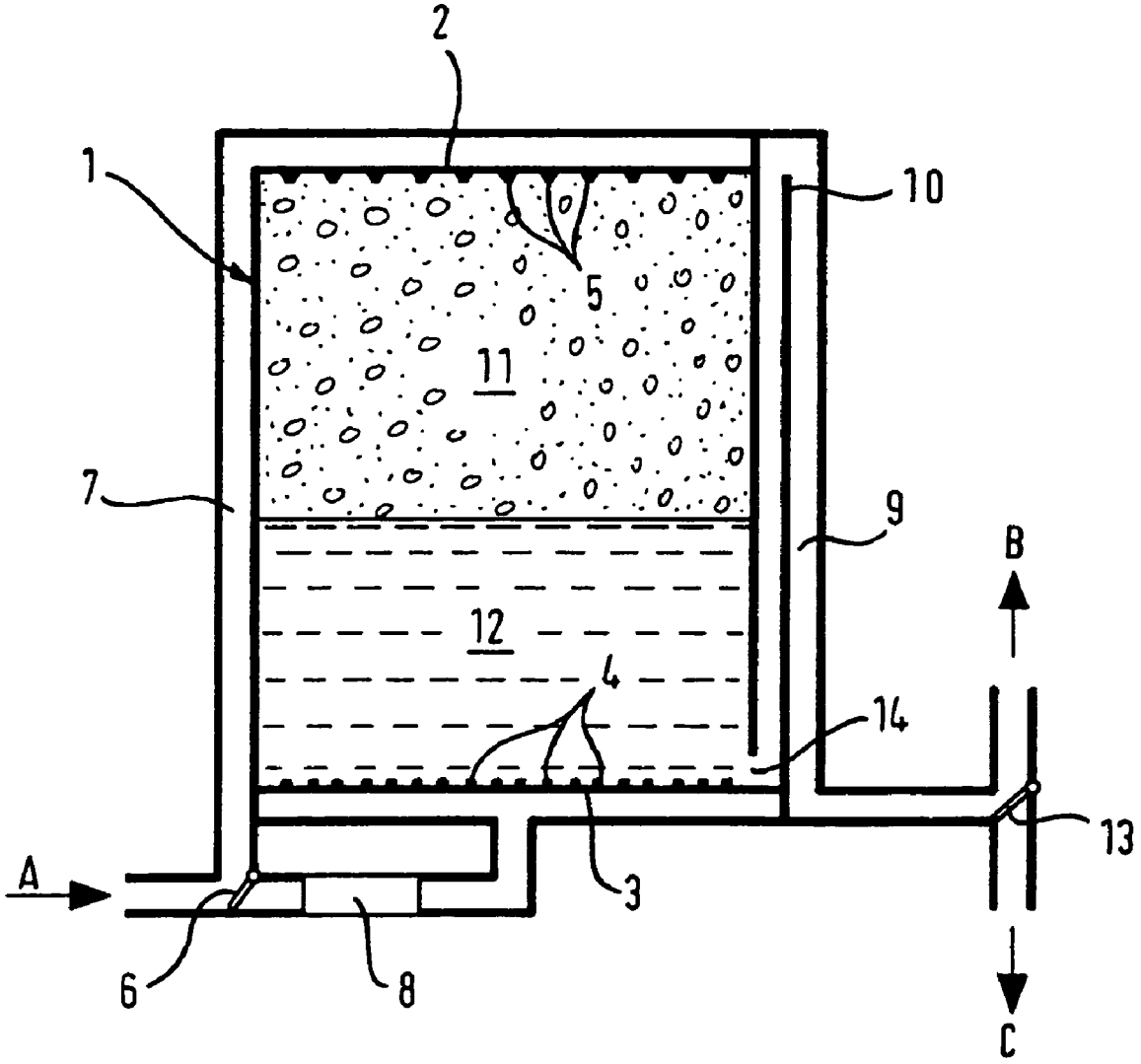
2
1
10
5
11
7
9
B
12
4
14
13
A
3
6
8
C

DISHWASHER COMPRISING A FILTER SYSTEM

BACKGROUND OF THE INVENTION

The invention relates to a dishwasher comprising a filter system for cleaning the dishwashing liquid and a method for operating the same.

During cleaning of items to be washed in a dishwasher, dishwashing residues are released from the items to washed, these accumulate in the dishwashing liquid and are partly circulated with the dishwashing liquid during the entire dishwashing process. The more dishwashing residues are entrained in the dishwashing liquid, the more disadvantageously this affects the dishwashing result. Furthermore, dishwashing residues entrained in the dishwashing liquid can become deposited in the transport paths of the dishwashing liquid or clog the sieves provided in the dishwasher.

Filter systems in the form of sieve devices which can be removed from the dishwasher, cleaned and re-inserted again have already been proposed to eliminate this problem. These sieve devices have the disadvantage that the cleaning process is laborious and unpleasant for the user. Furthermore, the cleaning process is frequently forgotten or carried out too infrequently so that problem-free operation of the dishwasher can no longer be ensured as a result of clogging of the sieve devices and hindrance in the transport paths of the dishwashing liquid, which disadvantageously impairs the dishwashing result and in extreme cases, can result in destruction of the dishwasher.

In other known dishwashing machines attempts are made to improve the dishwashing result by using large quantities of water, long running times and multistage filter systems. These dishwashing machines have the disadvantage that they have an elevated energy and water requirement. In addition, the known filter systems are not in a position to filter out fine-grained impurities in the dishwashing liquid since the sieves even of multistage filter systems are too coarse-meshed or the finer-mesh sieves impede the circulation of the dishwashing liquid in the dishwasher.

SUMMARY OF THE INVENTION

It is thus the object of the present invention to provide a dishwasher comprising a filter system for cleaning the dishwashing liquid and a method for operating the same wherein the dishwashing residue entrained in the dishwashing liquid can be removed more effectively from the dishwashing liquid and thus improve the dishwashing result. At the same time, fine-grained contaminant particles should be removed from the dishwashing liquid as far as possible in order to minimise re-contamination of the dishwashing liquid or the items to be washed. A further object of the present invention is to improve the ease of maintenance of the dishwashing machine and to minimise the water and energy requirement.

In the dishwasher according to the invention, a filter system is provided for cleaning dishwashing liquid, wherein at least some of the dishwashing liquid is led out from the washing cycle of the dishwashing machine through a foam volume so that dishwashing residue contained in the dishwashing liquid is at least partially absorbed or retained by the foam volume.

In the method according to the invention for operating a dishwashing machine comprising a filter system for cleaning dishwashing liquid, a foam volume is first produced, at least some of the dishwashing liquid is led out from the washing cycle of the dishwashing machine through a foam volume, wherein dishwashing residue contained in the dishwashing liquid is at least partially absorbed or retained by the foam volume, the cleaned liquid is then at least partially fed back to the washing cycle of the dishwashing machine again and the foam volume containing the retained dishwashing residue is at least partly led out from the dishwashing machine.

A basic idea of the present invention is consequently to use foam to retain fine and extremely fine dishwashing residue from the dishwashing liquid to clarify the washing solution in dishwashing machines. A dishwasher according to the invention comprising a filter system for cleaning the dishwashing liquid and a method according to the invention for operating the same has the advantage that the dishwashing residue entrained in the dishwashing liquid is effectively removed from the dishwashing liquid, whereby fine-grained contaminant particles are removed from the dishwashing liquid, thereby minimising the back-contamination of the dishwashing liquid or the items for washing and improving the dishwashing result.

A further advantage of the dishwashing machine and the method according to the present invention is that laborious cleaning of filters is eliminated since the filter system of the dishwasher according to the invention comprises no sieve, which enhances the ease of maintenance of the dishwasher. Furthermore, in the dishwashing machine and the method according to the present invention the energy and water requirement is reduced since the dishwashing liquid need not be changed so frequently or mixed with fresh water and the required washing time is shorter.

Further advantages of the dishwasher according to the invention comprising a filter system for cleaning the dishwashing liquid and a method according to the invention for operating the same are obtained from the following description of preferred embodiments.

In a particularly advantageous embodiment of the present invention,

The filter system comprises a foam developer wherein liquid, preferably dishwashing liquid, is mixed with air to produce the foam volume. Alternatively, the foam volume could be produced using fresh water which is supplied to the dishwasher especially for this purpose. However, producing the foam volume using dishwashing liquid has the advantage that the dishwashing liquid is already present in the dishwashing machine and contains detergents which promote the foaming of the dishwashing liquid. For this purpose, the dishwashing liquid is preferably supplied to the foam developer from the dishwashing cycle by a circulating pump of the dishwashing machine. On the one hand, the need for an additional pump for operating the foam developer is thereby avoided and on the other hand, the transport paths of the dishwashing liquid from the dishwashing cycle into the foam developer are simplified.

A filter container which receives the foam volume is appropriately provided. In this case, one wall of the filter container, preferably the bottom, has openings at least in part, through which air or a mixture of liquid and air can be introduced into the filter container. If the filter container is partly filled with dishwashing liquid, air can be introduced into the filter container via the openings at the bottom of the filter container so that a mixture of air and dishwashing liquid develops in the filter container and produces the foam volume.

Furthermore, one wall of the filter container, preferably the top, has at least one opening through which the dishwashing liquid can be introduced into the filter container. Advantageously, at least one opening for introducing dishwashing liquid into the filter container is constructed as a distributor nozzle so that the dishwashing liquid is introduced into the filter container in fine jets. It is thereby ensured that the dishwashing liquid comes in contact with the foam volume over the largest possible surface area. The dishwashing liquid introduced via the openings in the top of the filter container trickles in fine jets through the foam volume, whereby the dishwashing residue contained in the dishwashing liquid is at least partly absorbed or retained by the foam volume.

The filter container can be fitted with a first outlet through which the cleaned dishwashing liquid is led from the filter container and a second outlet through which the foam volume is led from the filter container. In this way, a distinction can be made between passing out the cleaning dishwashing liquid from the filter container and pumping away the foam volume or both processes can be carried out independently of one another, simultaneously, or at different times.

In a further embodiment of the present invention, the filter container comprises an outlet through which both the cleaned dishwashing liquid and also the foam volume is fed from the filter container to a three-way valve by which it is either fed back into the dishwashing cycle or passed into a waste water pipe of the dishwashing machine. The three-way valve is preferably regulated by an electronic program control of the dishwashing machine. By means of different valve positions of the three-way valve, it can be brought about, for example that either the cleaning dishwashing liquid is passed back from the filter container into the dishwashing cycle or that the foam volume containing the dishwashing residue is conveyed from the filter container via a waste water pipe from the dishwashing machine.

The outlet of the filter container can be equipped with a preferably variable-height overflow so that if the filter container is overfilled or too much foam is produced, an overflow from the filter container can be achieved. As a result of the variable height of the overflow, the maximum filling level of the filter container can be arbitrarily specified. The filter system can be accommodated in a particularly space-saving manner in the dishwashing machine if the filter container is located between a washing container and an outer wall of the dishwashing machine.

The method for operating a dishwashing machine comprising a filter system according to the present invention for cleaning dishwashing liquid comprises the steps that firstly, a foam volume is produced, at least some of the dishwashing liquid is led out from the washing cycle of the dishwashing machine through a foam volume, wherein dishwashing residue contained in the dishwashing liquid is at least partially absorbed or retained by the foam volume, the cleaned liquid is at least partially fed back to the washing cycle of the dishwashing machine and the foam volume containing the retained dishwashing residue is at least partly led out from the dishwashing machine.

In a particularly advantageous embodiment of the method according to the invention, the foam volume is produced in the foam developer, wherein liquid, preferably dishwashing liquid is mixed with air and the foam volume is then introduced into the filter container. Alternatively, the foam volume can also be produced directly in the filter container by introducing air into the filter container, for example, through openings disposed in the bottom of the filter container which had previously been partly filled with dishwashing liquid.

After the filter container has been partly filled with dishwashing liquid, the actual filtering process can begin whereby the dishwashing liquid to be cleaned is introduced into the filter container through openings arranged in the top of the filter container, the dishwashing liquid being distributed by the openings such that the dishwashing liquid trickles through the foam volume in the finest possible jets. The filter process described above can be repeated many times or carried out continuously during the washing process.

BRIEF DESCRIPTION OF THE DRAWINGS

The present invention is explained hereinafter using an exemplary embodiment with reference to the drawings. The drawing shows a cross-section through a filter system in an embodiment in which it can be used, for example, in a dishwasher according to the present invention.

DETAILED DESCRIPTION OF THE INVENTION

In the embodiment shown in the drawings, the filter system comprises a filter container 1 which is partly filled with dishwashing liquid 12 in the lower area and is filled with a foam volume 11 in the upper area. Dishwashing liquid is conveyed via a feed pipe 7 in the direction of the arrow A, to the filter container 1 preferably by a circulating pump (not shown) of the dishwashing machine. Located in the top 2 of the filter container 1 are a number of openings 5 through which dishwashing liquid is introduced into the filter container 1. The feed pipe 7 has a first three-way valve 6 which, by means of different valve positions, either causes the dishwashing liquid to be passed into the filter container 1 or into a foam developer 8 by the circulating pump. In the foam developer the dishwashing liquid is mixed with air to produce a foam volume 1 which is introduced into the filter container 1 via openings 4 in the bottom 3 of the filter container 1. As a result, a mixture of air and dishwashing liquid and the foam volume 11 is formed in the filter container 1.

If the filter container 1 is filled at least partly with the foam volume 11, dishwashing liquid is introduced into the filter container 1 via the openings 5 in the top 2 of the filter container 1, the foam volume 11 as it were being rained upon with dishwashing liquid from above. The dishwashing liquid then trickles in fine jets through the foam volume 11, whereby dishwashing residues contained in the dishwashing liquid are at least partly absorbed or retained by the foam volume 11; this process is the actual filter process. After the dishwashing liquid has flowed through the foam volume 11 and the entrained dishwashing residues have been delivered at least in part to the foam volume 11, the cleaning dishwashing liquid 12 collects in the lower area of the filter container 1 whilst the foam volume 11 floats on the cleaned dishwashing liquid 12 as a result of its lower density.

In its lower area the filter container 1 has an outlet 14 through which both the cleaned dishwashing liquid 12 and also the foam volume 11 is passed from the filer container 1 via a drain pipe 9 to a second three-way valve 13. Through different valve positions of the second three-way valve 13, the cleaned dishwashing liquid 12 is either passed back from the filter container 1 in the direction of the arrow B into the dishwashing cycle of the dishwashing machine or the foam volume 12 containing the dishwashing residue is conveyed from the filter container 1 in the direction of the arrow C via a waste water pipe from the dishwashing machine.

The drain pipe 9 which adjoins the outlet 14 of the filter container 1 is equipped with an overflow 10 to allow an overflow from the container 1 if the filter container 1 is overfilled or too much foam is produced. The height of the overflow 10 determines the maximum filling level of the filter container 1.

As a result of the difference in density between the dishwashing liquid 12 and the foam volume 11, when emptying the filter container 1 through the outlet 14 disposed in the lower area of the filter container, first the dishwashing liquid 12 and then the foam volume 11 is conveyed from the filter container 1. If desired, the cleaning dishwashing liquid 12 can naturally also be conveyed by a corresponding valve position of the second three-way valve 13 in the direction of the arrow B via a waste water pipe from the dishwashing machine. Both the first three-way valve 6 and also the second three-way valve 13 are preferably regulated by an electronic program control of the dishwashing machine.

Using a foam volume to clean the dishwashing liquid in a dishwasher according to the present invention and using a foam volume according to the method in accordance with the invention for operating a dishwasher consequently filters out even the smallest contaminant particle from the dishwashing liquid without the need for a fine-meshed sieve, minimises the back contamination of the dishwashing liquid or the items to be washed, thereby improving the dishwashing result and ease of maintenance and reducing the water and energy requirement of the dishwasher.

REFERENCE LIST

1 Filter container
2 Top of filter container 1
3 Bottom of filter container 1
4 Openings in bottom 3 of filter container 1
5 Openings in top 4 of filter container 1 or distributor nozzle
6 Three-way valve in feed pipe 7
7 Feed pipe
8 Foam developer
9 Drain pipe
10 Overflow in drain pipe 9
11 Foam volume
12 Cleaned dishwashing liquid
13 Three-way valve in drain pipe 9
14 Outlet in filter container 1
A Direction of flow of dishwashing liquid to filter container 1
B Direction of flow of dishwashing liquid to dishwashing cycle
C Direction of flow of dishwashing liquid to waste water pipe

The invention claimed is:

1. A dishwashing machine comprising:

a dishwashing container in which items to be subjected to the application of a dishwashing liquid thereto are disposed; and a filter system for cleaning dishwashing liquid, the filter system including a foam volume and the filter system and the dishwashing container being communicated with one another such that at least some of the dishwashing liquid can be discharged from the dishwashing container in association with a washing cycle of the dishwashing machine to the foam volume for passage of the discharged dishwashing liquid through the foam volume, wherein dishwashing residue contained in the dishwashing liquid is at least partially absorbed or retained by the foam volume.

2. The dishwashing machine according to claim 1, wherein the filter system includes a foam developer operable to mix liquid formed of at least one of the dishwashing liquid and a non-dishwashing liquid with air to produce the foam volume.

3. The dishwashing machine according to claim 2, wherein dishwashing liquid is supplied to the foam developer by a circulating pump from the dishwashing cycle of the dishwashing machine.

4. The dishwashing machine according to claim 1 and further comprising a filter container is provided for retaining therein the foam volume.

5. The dishwashing machine according to claim 4, wherein the filter container includes a wall located at a selected one of the bottom of the filter container and another location on the filter container, the wall having openings over at least a portion thereof through which at least one of air and a mixture of liquid and air can be introduced into the filter container.

6. The dishwashing machine according to claim 4, wherein the filter container includes a wall located at a selected one of the top of the filter container and another location on the filter container, the wall having at least one opening through which the dishwashing liquid can be introduced into the filter container.

7. The dishwashing machine according to claim 6, wherein at least one opening in the wall for introducing dishwashing liquid into the filter container is configured as a distributor nozzle such that the dishwashing liquid is introduced into the filter container in fine jets.

8. The dishwashing machine according to claim 4, wherein the filter container has a first outlet through which cleaned dishwashing liquid is discharged from the filter container and a second outlet through which the foam volume is discharged from the filter container.

9. The dishwashing machine according to claim 8, wherein at least one of the first outlet and the second outlet has a variable-height overflow.

10. The dishwashing machine according to claim 4 and further comprising a three-way valve and the filter container has an outlet through which both cleaned dishwashing liquid and the foam volume is discharged from the filter container to the three-way valve via selective positioning of which cleaned dishwashing liquid is conducted back into the dishwashing cycle and discharged foam volume is passed into a waste water pipe of the dishwashing machine.

11. The dishwashing machine according to claim 4, wherein the filter container is disposed between the dishwashing container and an outer wall of the dishwashing machine.

12. A method for operating a dishwashing machine, the dishwashing machine including a dishwashing container in which items to be subjected to the application of a dishwashing liquid thereto are disposed and a filter system for cleaning dishwashing liquid, the filter system including a foam volume and the filter system and the dishwashing container being communicated with one another such that at least some of the dishwashing liquid can be discharged from the dishwashing container in association with a washing cycle of the dishwashing machine to the foam volume for passage of the discharged dishwashing liquid through the foam volume, wherein dishwashing residue contained in the dishwashing liquid is at least partially absorbed or retained by the foam volume, the method comprising the steps of:

discharging at least some of the dishwashing liquid from the washing cycle of the dishwashing machine through the foam volume, wherein dishwashing residue contained in the dishwashing liquid is at least partially absorbed or retained by the foam volume;

conducting at least a portion of cleaned dishwashing liquid back to the washing cycle of the dishwashing machine; and conducting at least a portion of the foam volume containing the retained dishwashing residue exteriorly of the dishwashing machine.

13. The dishwashing machine according to claim 12 and further comprising producing the foam volume in a foam developer in which liquid, preferably dishwashing liquid, is mixed with air.

14. The dishwashing machine according to claim 12 and further comprising a selected one of producing the foam volume in a filter container and introducing the foam volume in a filter container after production of the foam volume.

15. The dishwashing machine according to claim 12 and further comprising effecting the passage of the dishwashing liquid to be cleaned through the foam volume via introduction of the dishwashing liquid in the form of fine jets by at least one distributor nozzle.

* * * * *